US006792741B1

(12) United States Patent
Theriault

(10) Patent No.: US 6,792,741 B1
(45) Date of Patent: Sep. 21, 2004

(54) CONTAINER PACKING SYSTEM

(76) Inventor: Dominic Theriault, 19 Dupuis, St-Jacques, QBC (CA), J0K 2R0

( * ) Notice: Subject to any disclaimer, the term of this patent is extended or adjusted under 35 U.S.C. 154(b) by 0 days.

(21) Appl. No.: 10/656,154

(22) Filed: Sep. 8, 2003

(51) Int. Cl.[7] ..... B65B 35/40; B65B 35/50

(52) U.S. Cl. ..... 53/443; 53/536; 53/537; 53/540; 53/245; 53/491; 53/241; 53/255

(58) Field of Search ..... 53/241, 255, 244–246, 53/390, 392, 376.4, 377.2, 377.3, 458, 491, 531, 534, 535–541, 543

(56) References Cited

U.S. PATENT DOCUMENTS

| | | | | | |
|---|---|---|---|---|---|
| 1,434,587 | A | * | 11/1922 | Broadley | 414/416.09 |
| 2,024,503 | A | * | 12/1935 | Bickford | 53/536 |
| 2,921,702 | A | * | 1/1960 | Gross | 414/416.09 |
| 3,338,009 | A | * | 8/1967 | Stevens | 53/245 |
| 3,435,738 | A | | 4/1969 | Berney | |
| 3,683,582 | A | | 8/1972 | Seguin | |
| 3,865,258 | A | | 2/1975 | Muller | |
| 3,866,392 | A | | 2/1975 | Weeks et al. | |
| 3,964,239 | A | | 6/1976 | Elford | |
| 4,028,864 | A | * | 6/1977 | Bell | 53/438 |
| RE29,372 | E | | 8/1977 | O'Brien | |
| 4,063,492 | A | * | 12/1977 | Lesek | 493/18 |
| 4,085,564 | A | | 4/1978 | Focke | |
| 4,463,541 | A | | 8/1984 | Nowacki | |
| 4,522,016 | A | * | 6/1985 | DiRico | 53/564 |
| 4,930,290 | A | | 6/1990 | Barker | |
| 4,939,891 | A | | 7/1990 | Podini | |
| 4,942,720 | A | | 7/1990 | Berney | |
| 5,022,214 | A | * | 6/1991 | Kim | 53/242 |
| 5,022,218 | A | * | 6/1991 | Prakken | 53/529 |
| 5,044,143 | A | * | 9/1991 | Ako et al. | 53/448 |
| 5,675,963 | A | | 10/1997 | Nicholson et al. | |
| 5,727,365 | A | * | 3/1998 | Lashyro et al. | 53/448 |
| 5,743,067 | A | * | 4/1998 | Trimani | 53/151 |
| 5,771,658 | A | | 6/1998 | Olson et al. | |
| 6,164,045 | A | | 12/2000 | Focke et al. | |

FOREIGN PATENT DOCUMENTS

| | | |
|---|---|---|
| GB | 2 098 570 A | 11/1982 |

* cited by examiner

*Primary Examiner*—Scott A. Smith
*Assistant Examiner*—Hemant Desai

(57) ABSTRACT

Container packing system for use with conveyed articles. The system includes a carton having four sidewalls with four carton upper edges and four carton lower edges. Four upper flaps are connected to the respective upper edges and four lower flaps are connected to the respective four lower edges. The sidewalls define a carton inner space sized to receive therein a layer of the conveyed articles. A movable support platform receives thereon the conveyed articles and is sized for location in the carton space between the sidewalls. The support platform is actuatable to move between the upper edges and the lower edges. Two of the lower flaps are folded inwardly and upwardly towards a lower surface of the movable support platform. A method of using the system to pack a carton is also provided.

31 Claims, 7 Drawing Sheets

CONTAINER PACKING SYSTEM

FIELD OF THE INVENTION

The present invention concerns packing systems and more particularly to a container packing system for conveyed articles.

BACKGROUND OF THE INVENTION

Packing systems are well known and widely used for packing articles such as foodstuff, smaller packages or collapsed smaller boxes into a larger box. Typically, the system includes a moving conveyor belt on which the articles travel, a movable platform and the box to be filled located at one end of the conveyor belt. The box is generally mounted around the platform edges and the platform moves downwardly once a layer of articles is added to the platform. An operator stands near the box and the conveyor belt end and places the articles in the box once the articles reach the conveyor belt end. Once one layer is added, the operator adds a divider or breaker sheet into the box and the process is repeated. Typically, a corrugated sheet is placed at the bottom of the box.

Several designs of packing systems exist, examples of which are as follows:

U.S. Pat. No. 3,683,582, issued Aug. 15, 1972 to Sequin for "Method of Loading Containers with Articles"; and UK Patent Application No. GB 2,098,570, published Nov. 24, 1982 to Clegg et al. for "Packaging Articles in Layers in a Carton".

The aforesaid designs suffer from a number of important drawbacks. In each case, the movable platform is located inside the box such that when a packing operation is complete, the platform exits through a lower end of the box, thus requiring either a complex apparatus design or an operator to laterally displace the box once filled. Disadvantageously, an operator must then manually invert the box for sealing the lower end after an upper end has been sealed. This may cause repeated use injury to the back especially if the box is packed with heavy articles. Also, if not properly sealed, the contents of the box may fall out during inversion. Furthermore, the boxes used with one design appears to require that a gap be present between two lower box flaps to accommodate therebetween the platform shaft, which may restrict the box's orientation to one packing position on the system. In addition, none of the box upper flaps are secured to the conveyor belt end, which could cause interference and damage to the flaps when the articles are off-loaded from the conveyor belt.

Thus there is a need for an improved container packaging system.

SUMMARY OF THE INVENTION

The present invention reduces the difficulties and disadvantages of the prior art by providing an ergonomically favorable and computer-controlled box packaging system that allows the box to be packed by a packer at substantially higher speed than the aforesaid designs. Advantageously, the system of the present invention allows the packer to receive conveyed articles from a conveyor belt in one hand and pass them to the other hand located in or above the box using a simple pendulum motion at waist height, by constantly filling the box at the upper level thereof without ever having to reach the bottom. The present invention achieves this by providing a novel arrangement of lower box flaps relative to a movable supporting platform that eliminates the need for the packer to invert the box once filled. The supporting platform and the lower box flaps are configured such that the box bottom is already closed when the box is filled. Furthermore; the aforesaid problems associated with the box flaps interfering with the path of article travel during the packing process are significantly reduced or essentially eliminated by securing one of the flaps to the conveyor belt frame such that the box is held securely in a packing position. In addition, the present packing system can be retrofitted into an existing packing system and may be adapted to boxes of various dimensions.

Accordingly, in a first embodiment of the present invention, there is provided a container packing system for use with conveyed articles, the system comprising: a carton having four sidewalls with first, second, third and fourth carton upper edges and first, second, third and fourth carton lower edges; first, second, third and fourth upper flaps connected to the respective first, second, third and fourth upper edges; first, second, third and fourth lower flaps connected to the respective first, second, third and fourth lower edges, the four sidewalls defining a carton inner space sized to receive therein a layer of the conveyed articles; and a movable support platform for receiving thereon the conveyed articles and being shaped and dimensioned for location in the carton space between the four sidewalls, the support platform being actuatable to move between the upper edges and the lower edges, the first and second lower flaps being folded inwardly and upwardly towards a lower surface of the movable support platform.

Typically, the third and fourth lower flaps depend downwardly from the third and fourth carton lower edges, the third and fourth lower flaps being located below the lower surface of the support platform. The third and fourth lower flaps fold inwardly and towards each other to close a carton lower end. The first and second lower flaps are sized and dimensioned smaller than the third and fourth lower flaps.

Typically, the first upper flap is folded outwardly and towards a conveyor belt having thereon the conveyed articles, the first upper flap being sandwiched between a pair of sandwich plates located at a conveyor belt end and connected to a sandwich plate support, the sandwich plates including an upper fixed plate and a lower hinged plate.

Typically, the conveyor belt, the first upper flap and the movable support platform are located in a common generally horizontal plane relative to each other, the articles moving from the conveyor belt over the upper fixed plate and onto the movable support platform. The lower hinged plate is actuatable between an open configuration for receiving the first upper flap and a closed flap holding configuration.

Typically, the movable support platform includes a support shaft having a vertical support shaft axis generally centrally positioned relative to the four sidewalls.

Typically, the movable support platform includes two side panels depending downwardly therefrom. The first and second lower flaps rest against the two side panels.

Typically, a fairly rigid bottom sheet supporting a plurality of partition walls thereon is located on the movable platform, each partition wall defining an article receiver portion. The articles are packed into adjacent article receiver portions in different orientations, the articles being packed into alternating orientations to attain a layer of articles.

Accordingly, in a second embodiment of the present invention, there is provided a method of packing a carton with articles from a conveyor belt, comprising: moving downwardly two lower carton flaps folded inwardly and upwardly towards a lower surface of a movable support platform, the movable support platform being sized and dimensioned to be located between four carton sidewalls and to receive thereon the articles, so as to pack the carton with a layer of the articles.

BRIEF DESCRIPTION OF THE DRAWINGS

Further aspects and advantages of the present invention will become better understood with reference to the description in association with the following Figures, wherein.

DETAILED DESCRIPTION OF THE PREFERRED EMBODIMENTS

Figure 1:
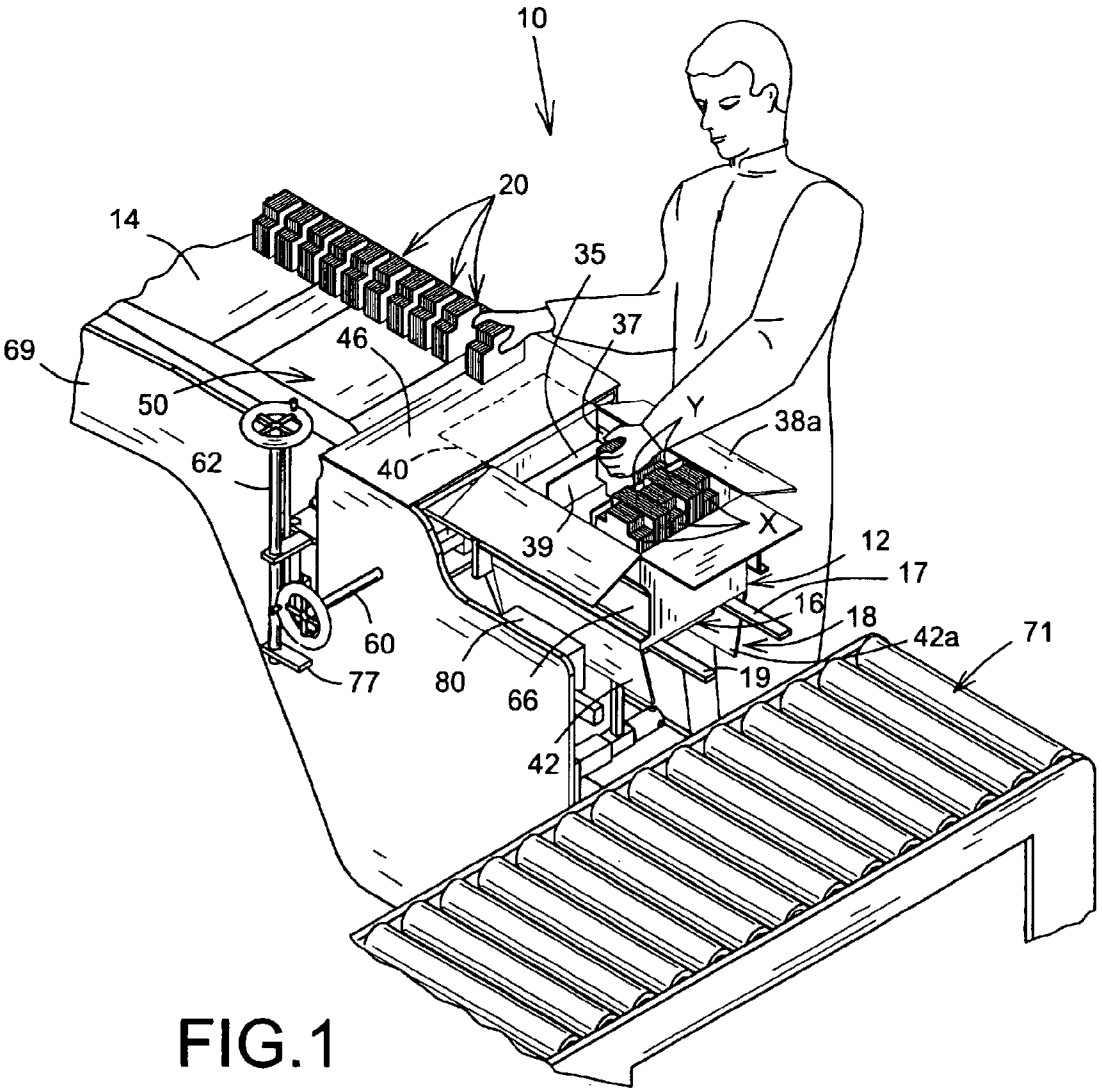
FIG. 1 is a simplified partial perspective view of an embodiment of a packing system.

Referring now to FIG. 1, an embodiment of a container packing system is shown generally at 10. Broadly speaking, the system includes a carton 12, a conveyor belt 14, a movable support platform or plate 16 and a support frame structure 18. The conveyor belt 14 merely conveys a number of articles 20 towards the support platform 16.

Figure 2:
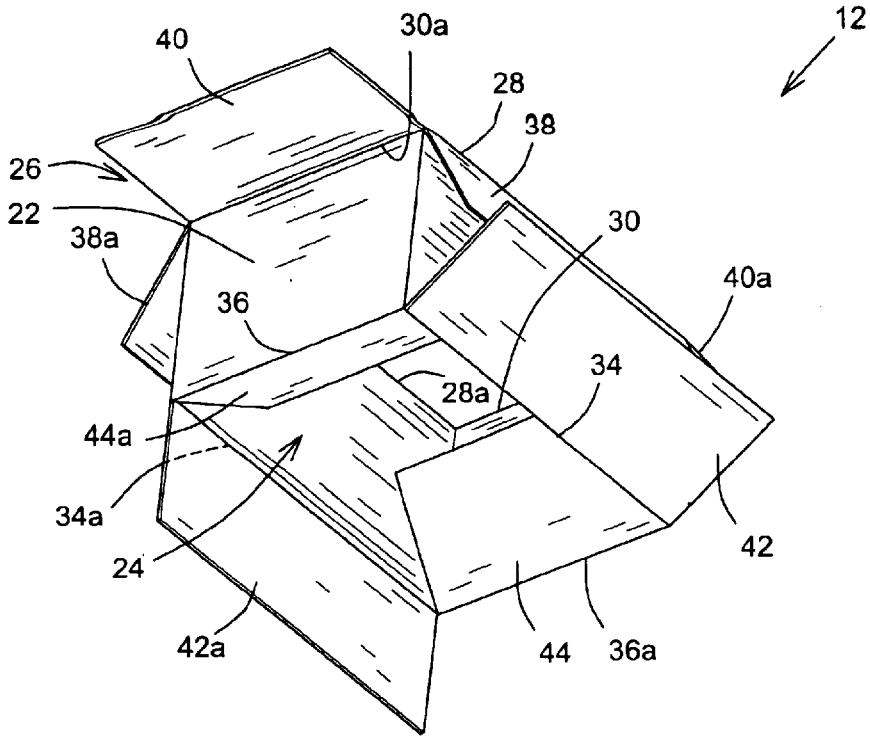
FIG. 2 is a worm's eye perspective view of a box used in the packing system.

As best illustrated in FIG. 2, the carton or box 12 is typically square or rectangular shaped and is constructed from materials known to those skilled in the art such as corrugated cardboard and the like. One skilled in the art will recognize that other shaped boxes may also be used without deviating from the scope of the invention. The box 12 includes with four sidewalls 22 that define an inner space 24 that is sized to receive the articles 20. The box 12 is orientated on the support platform 16 so as to define an upper box end 26 with four upper box edges 28, 28*a*, 30, and 30*a*, and a lower box end 32 with four lower box edges 34, 34*a*, 36, and 36*a*. Four upper box flaps 38, 38*a*, 40, and 40*a* are connected to the respective upper box edges 28, 28*a*, 30, and 30*a*. Four lower box flaps 42, 42*a*, 44, and 44*a* are connected to the respective lower box edges 34, 34*a*, 36, and 36*a*. Many different box dimensions may be used without deviating from the scope of the invention. Typically, the lower flaps 44, 44*a* are sized and dimensioned smaller than the lower flaps 42, 42*a*.

Figure 3:
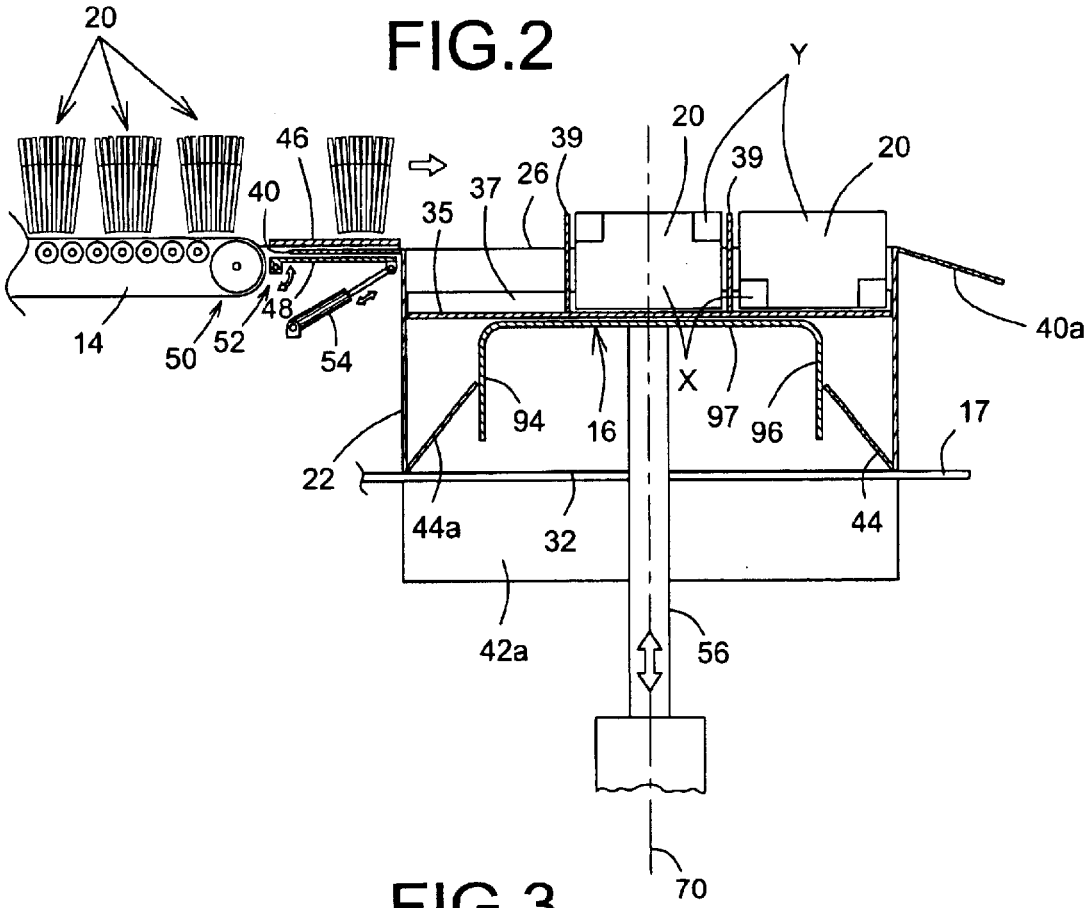
FIG. 3 is a simplified partial side section view showing articles on a conveyor belt being packed into the box.

As best illustrated in FIG. 3, a pair of sandwich plates, a fixed upper plate 46 and a hingeable lower plate 48 are located at a conveyor belt end 50. The lower plate 48 is hingeably connected to a sandwich plate support 52 located near the belt end 50. An actuator 54, typically a pneumatic piston, is connected to the lower sandwich plate 48 and moves the lower plate 48 relative to the upper sandwich plate 46 to attain a flap holding or clamping configuration. The upper flap 40 is folded outwardly and towards the conveyor belt 14 and is sandwiched between the sandwich plates 46, 48 during a packing operation, in which the conveyor belt 14, the upper flap 40, the sandwich plates 46, 48 and the vertically movable support platform 16 are located in a common generally horizontal plane relative to each other to receive the articles 20 moving from the conveyor belt 14. The free upper flap 40*a* is located away from the conveyor belt end 50.

Referring now to FIGS. 3 through 7, the movable support platform 16 is operatively interconnected to the support frame apparatus 18. The support frame apparatus 18 includes a support platform shaft 56, a first actuator 58, a second actuator 60, a third actuator 62, a fourth actuator 63, a fifth actuator 65, a fixed guide member 64, a transversely movable guide member 66 and a vertically movable support table 68. The support apparatus 18 is typically housed in an open front housing 69 between the conveyor belt end 50 and an exit ramp 71. The support platform shaft 56 has a longitudinal generally vertical support platform shaft axis 70 that is generally centrally positioned relative to the four sidewalls 22 of the box 12, when mounted upon two generally parallel longitudinal support bars 17, 19, as will be described in more detail below. The movable support platform 16 is sized and shaped for location in the carton inner space 24 between the four box sidewalls 22.

The first actuator 58 is connected to the support shaft 56 via a generally horizontal telescoping shaft 72 mounted on grooved block member 73 that moves the platform 16 along a generally transversal horizontal path of travel, as illustrated by arrows (A). The fourth actuator 63 mounted on the housing 69 via mounting bracket 74 is connected to a mobile support frame, which includes a support block 75 attached to two spaced apart vertical guiding bars 76, 78 that are connected to two grooved block members 80, 82. The block members 80, 82 are slidably mounted on two generally horizontal guiding bars 84, 86 fixed to the housing 69, which allow the fourth actuator 63 to move the block members 80, 82 in the longitudinal direction of the arrows (C). The vertical bar 76 is operatively displaced by the fifth actuator 65, which is driven by a motor M. The fifth actuator 65 is connected to first actuator 58 via the grooved block member 73 that is vertically slidably mounted on the vertical bars 76, 78. Operation of the motor M causes the fifth actuator 65 to move the block member 73 along a generally vertical path of travel, as illustrated by the arrows (B), which in turn causes vertical movement of the support platform 16.

The second actuator 60 is mounted on the movable support table 68 and is connected to the movable guide member 66 and to the support bar 19 via an attachment panel 88. The second actuator 60 transfers movement along a generally transversal horizontal path of travel, as illustrated by arrows (D) to the movable guide member 66 and support bar 19. The movable guide member 66 moves relative to the fixed guide member 64 to accommodate boxes 12 placed therebetween of various dimensions. A pair of stabilizer guide shafts 90, 91 are connected to the panel 88 away from the movable guide member 66 and are located parallel to the second actuator 60. The includes A pair of slider blocks 92, 93 attached to the panel 88 are slidably connected to the stabilizer guide shafts 90, 91 to move along a transversal path of travel, as illustrated by arrows (E).

The third actuator 62, mounted on the housing 69 via mounting bracket 77, is connected to the movable support table 68 and moves the support table 68, which is typically located underneath the conveyor belt end 50, along a generally vertical path of travel, as illustrated by arrows (F), to accommodate boxes of various depths between the upper sandwich plate 46 and the longitudinal support bars 17, 19. The movable support table 68 is attached to four generally parallel guiding rods 81 that are in slidable engagement with four bearing blocks 83 secured to the housing 69. The movable support table 68 supporting the fixed and movable guide members 64, 66 and the support bars 17, 19 moves the latter along the path of travel (F) to locate the support bars 17, 19 at a proper vertical distance from the upper sandwich plate 46. The first, second, third, fourth and fifth actuators, in the embodiment of the invention, are typically worm gears that may be manually operated or may be computer-controlled (not shown). More specifically, the fifth actuator 65 is activated by motor M that is preferably computer-controlled. One skilled in the art will recognize that many different types of actuator may be used to achieve the same desired result, without deviating from the scope of the invention.

Figure 6:
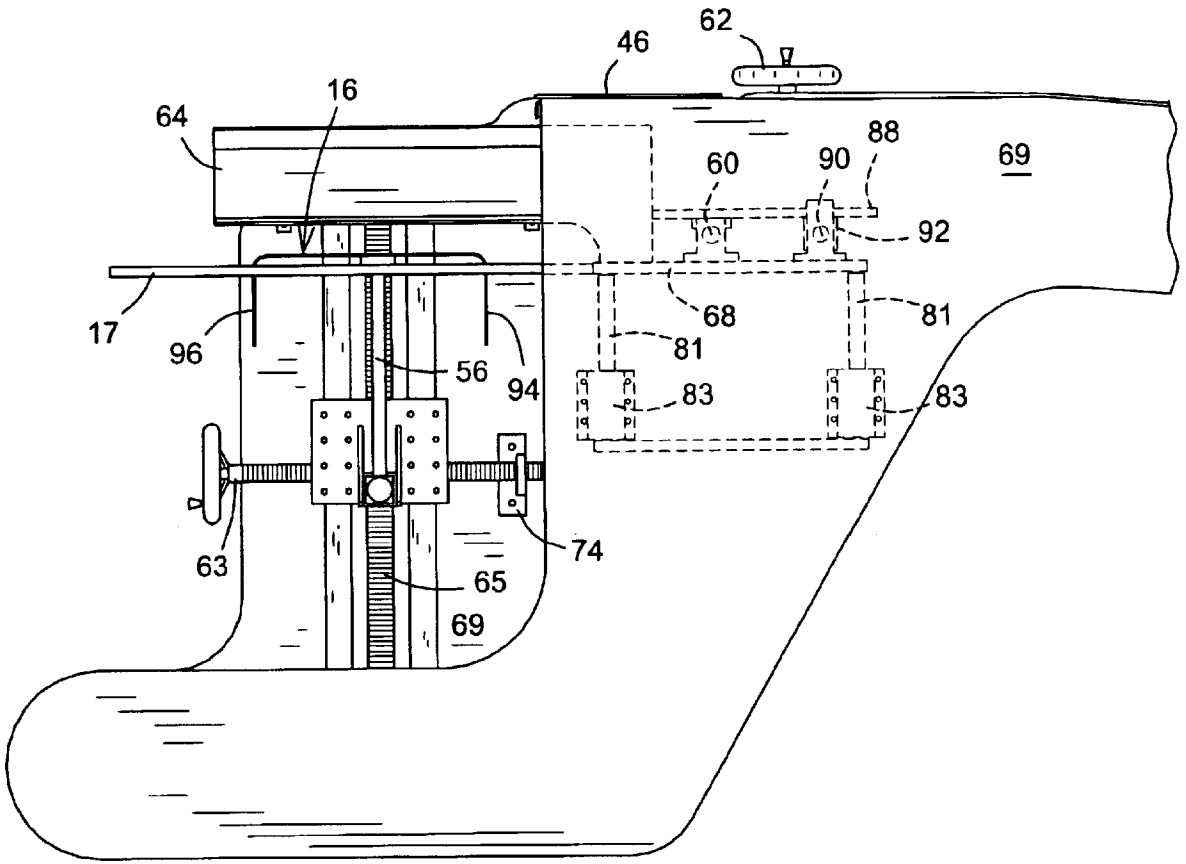
FIG. 6 is a simplified partial side view of the movable support platform and the support frame apparatus.
Figure 7:
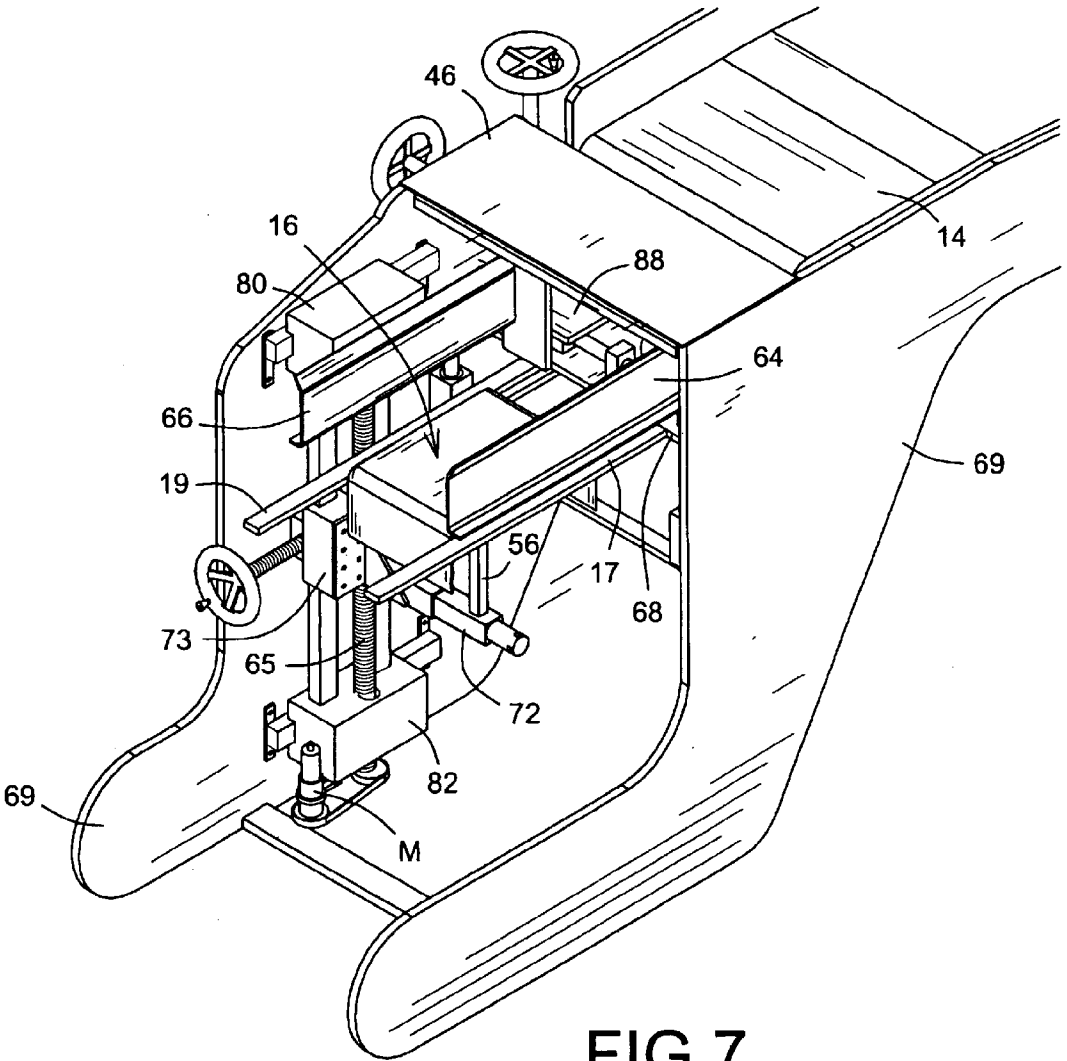
FIG. 7 is a simplified partial perspective view of the support frame apparatus viewed from a packer's side.

As best illustrated in FIGS. 3 and 6, the support platform 16 includes two depending side panels 94, 96 located on the platform sides 16 nearest and farthest from the conveyor belt end 50, and depend from a platform lower surface 97. The support platform 16 is actuatable to move between the upper box end 26 and the lower box end 32, typically using a worm gear 65 that is computer-controlled via motor M.

Figure 4:
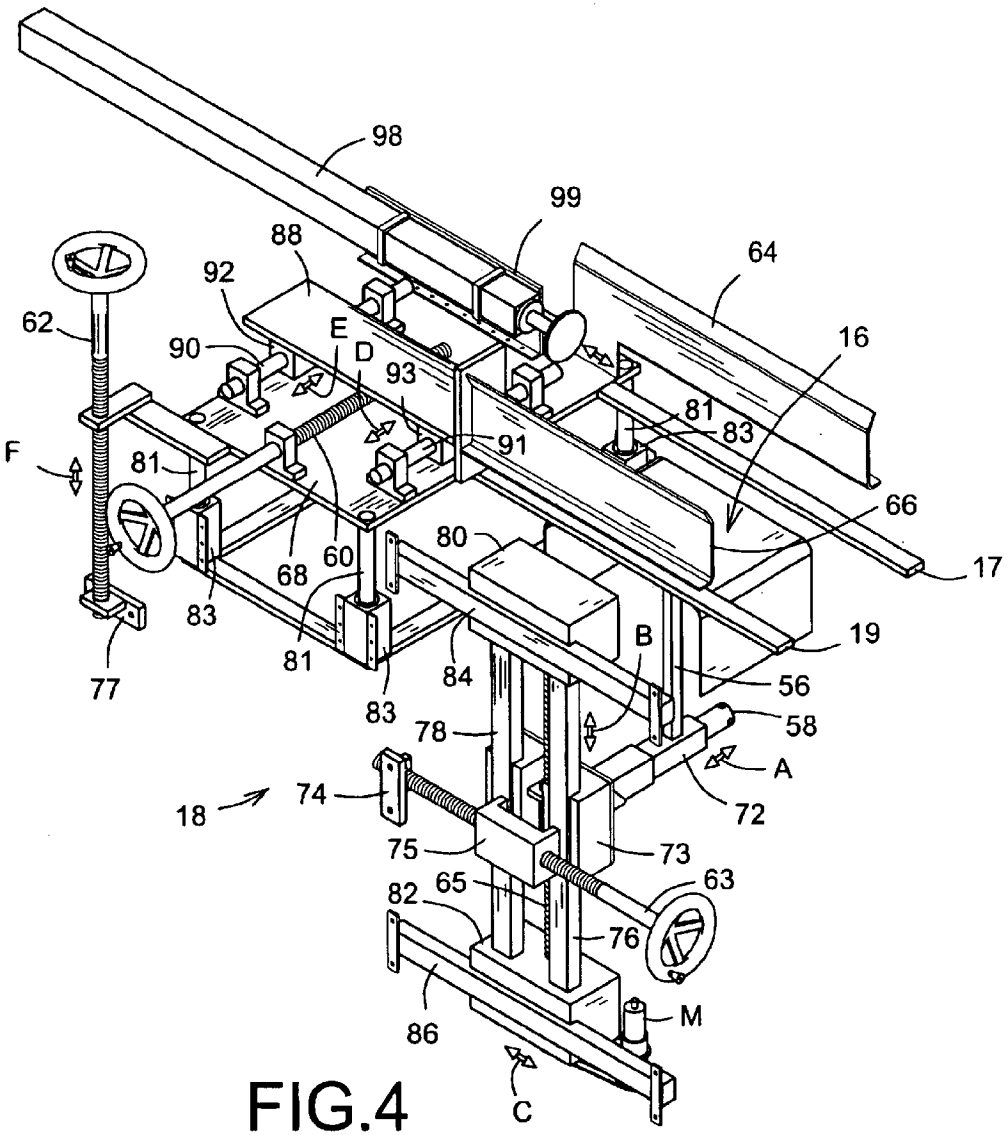
FIG. 4 is a is a simplified perspective partial view of a support frame apparatus with a movable support platform.
Figure 5:
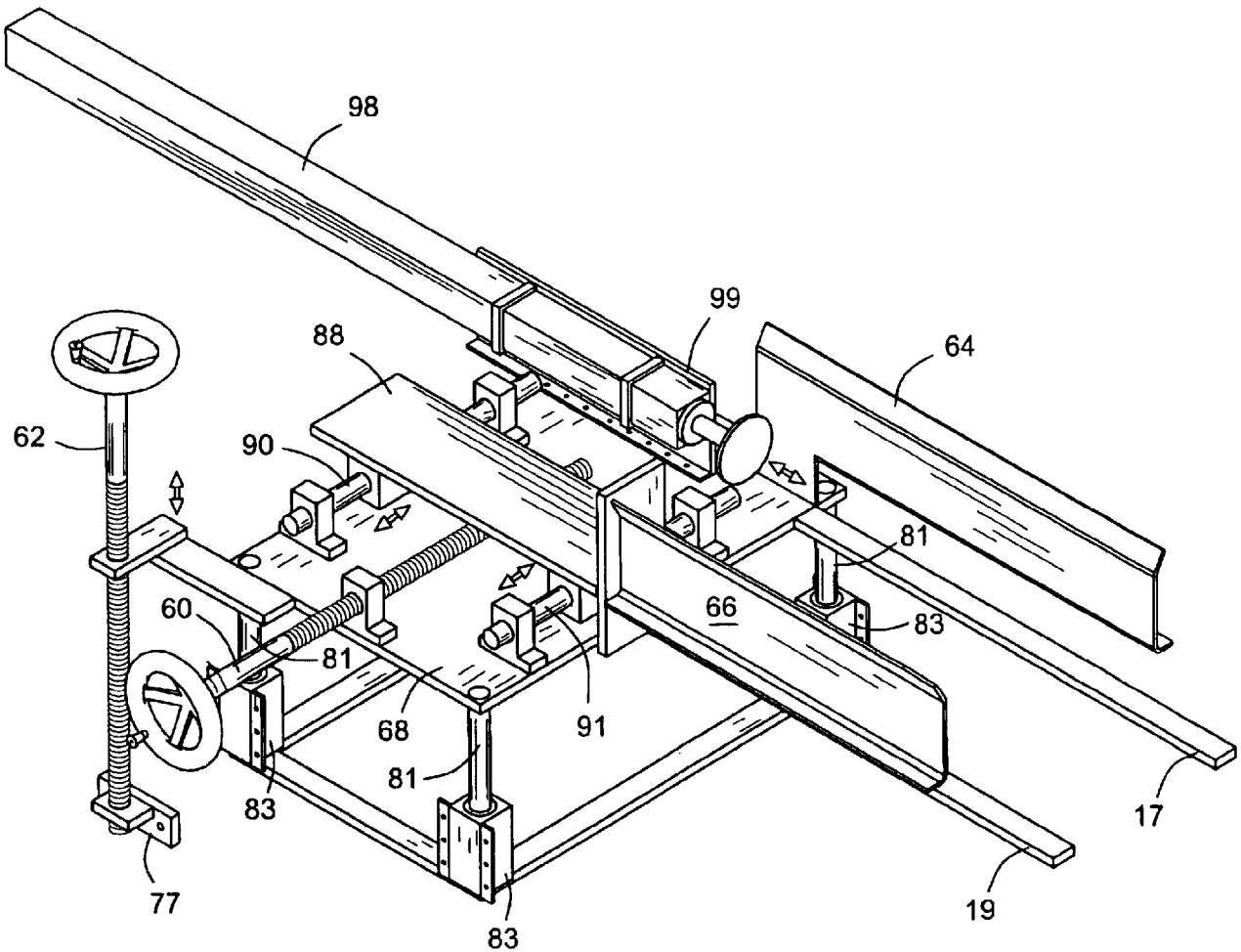
FIG. 5 is the same as FIG. 4 without the movable support platform.

Referring now to FIGS. 4 and 5, a typically pneumatic piston 98, attached to the movable support table 68 via mounting plate 99 below the conveyor belt end 50, is used to push the boxes onto the exit ramp 71 once filled and to eventually stabilize the box 12 once positioned on the support bars 17, 19.

Operation

A typical operation of the system will now be described with reference to FIGS. 1, 2 and 3, beginning with the box 12 in a non-filled configuration, as shown in FIG. 2. The packer positions the box 12 onto the support bars 17, 19 with the lower box edges 36, 36*a* abutting thereon and with the two lower flaps 44, 44*a* oriented upwardly and resting against the two depending platform panels 96, 98 of the support platform 16, respectively. The two remaining lower flaps 42, 42*a* depend downwardly on either side of the movable support platform 16. A fairly rigid bottom sheet 35 supporting a number of partition walls 39 thereon is positioned on top of the support platform 16 with the partition walls 39 located away from the platform 16 and generally orthogonal and/or parallel to the direction of the conveyor belt's 14 movement. The bottom sheet 35 generally includes flaps 37 extending generally upwardly therefrom that prevent sidemost relatively thin articles 22 from slipping off the box 12 between the bottom sheet 35 and respective sidewall 22 during filling of the box 12.

The upper flap 40 is sandwiched between the upper and lower sandwich plates 46, 48 and secured therebetween. The upper sandwich plate 46 now acts as a bridge between the end 50 of the conveyor belt 14 and the box inner space 24. The opposing upper flap 40*a*, and the two remaining upper flaps 38, 38*a* depend generally downwardly from their respective upper box edges. With the support platform 16 located just below the upper box edge 26, as best illustrated in FIG. 2, the packer positions himself adjacent the fixed guide member 64. Referring now to FIG. 3, the conveyor belt 14 is activated and the articles 20 move therealong.

At a location adjacent the upper sandwich plate 46, the packer's right hand grabs a first predetermined number of the articles 20 and moves them over to the receiver portions of the box 12 near his left hand, which is located above the box 12, using a pendulum-like movement. The articles 20 are then placed into an article receiver portion using packer's right hand, between the partitioned wall 39 of the box 12 furthest from the upper sandwich plate 46 and the box sidewall 22 in a first orientation (X), as seen in FIGS. 1 and 3. During this time, the packer uses his left hand to retain the previously packed articles 20 in the upright position until the partitioned receiver portion gets entirely filled. This operation is repeated with a second predetermined number of articles 20, which are placed into the same partitioned receiver portion of the box 12 next to the first number of articles 20, but in a second orientation (Y) that is upside-down relative to the first number of articles in the first orientation (X) so as to uniformly distribute the articles 20 therein since each predetermined number of articles are generally of non-uniform dimensions at the top and bottom surfaces thereof, from different top and bottom thickness of each individual article 20, as illustrated in FIG. 3 on the conveyor belt 14. Each of the partitioned receiver portions of the box 12 are filled with the articles 20 in alternating orientations, until all the receiver portions of the first layer of articles are produced. A divider sheet (not shown) may be added to cover the first layer of articles and the support platform moved down (preferably via computer control) to allow the operation to be repeated until the box 12 is completely filled with multiple layers of articles 20, at which time the support bars 17, 19 substantially support the entire box 12 and contents thereupon. As the movable platform 16 moves downwardly, the two lower flaps 44, 44*a* move upwardly relative thereto and slide between the support platform 16 and the bottom sheet 35 until, once the box is filled, they are located generally parallel to and above the platform 16. This allows the remaining two lower flaps 42, 42*a* to be secured over the flaps 44, 44*a* using a securing means such as tape or staples.

One skilled in the art will understand that even though the two lower flaps 44, 44*a* are illustrated as being folded upwardly and towards the lower surface 97 of the movable platform 16 and resting against the two depending panels 94, 96, the lower flaps 44, 44*a* may also be folded upwardly and towards the lower surface 97 and resting thereagainst, without deviating from the scope of the invention. The box 12 passes onto the exit ramp 71 for transfer to a completion point (not shown).

Alternatives

The first embodiment of the system is shown for use with boxes that pass from the movable platform, once filled, onto the exit ramp 71 for closing by manually folding the lower flaps 42, 42*a*, but the lower flaps 42, 42*a* can also be folded automatically before the boxes pass onto the exit ramp 71.

Figure 9:
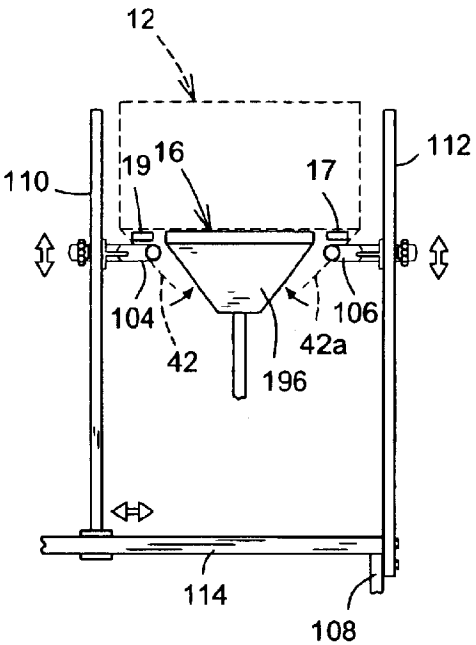
FIG. 9 is a simplified end view of the packing system of FIG. 8.
Figure 8:
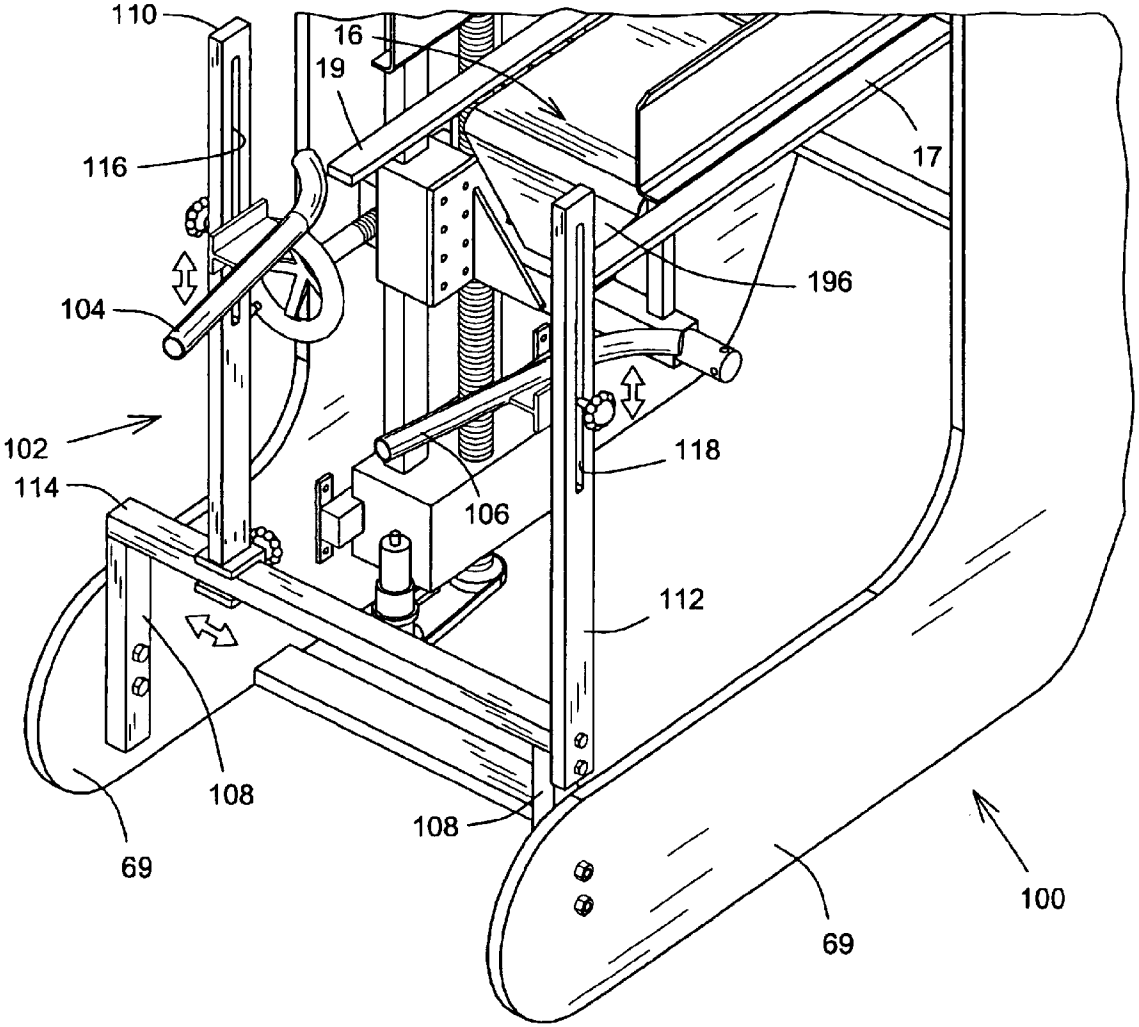
FIG. 8 is a simplified partial perspective view of alternative embodiment of the packing system.

Referring now to FIGS. 8 and 9, an alternative embodiment of the system is shown generally at 100 and includes a flap folder apparatus 102 located between the exit ramp 71 (not shown) and the support platform 16. The flap folder apparatus 102 includes two curved rods 104, 106 that are adjustably mounted on a flap folder frame 108. The flap folder frame 108 is connected to the open front housing 69 and includes two generally vertical posts 110, 112 and a cross bar 114. Two slots 116,118 are located in the upper part of the posts 110, 112 to which the rods 104, 106 are slidably connected to allow vertical height adjustment thereof. The post 110 is adjustably connected to the cross bar 114 in a horizontal direction to allow transversal horizontal width adjustment, which in combination with the vertical height adjustment allows the apparatus to accommodate boxes of several dimensions.

Operation of the alternative embodiment 100 is essentially identical to the first 10 in that once the box 12 (shown in dashed lines in FIG. 9) is filled with the articles 20, it is moved from the support bars 17, 19 under the action of piston 98, whereupon the two lower flaps 42, 42*a* contact the two rods 104, 106 and are folded inwardly and upwardly towards the flaps 44,44*a* as they pass therebetween. Once the lower flaps 42, 42*a* are folded, the box exits onto the exit ramp 71. In order to allow generally unobstructed inward and upward folding of flaps 42, 42*a*, the depending panels 196 of the support platform 16 are formed so as to taper downwardly on both lateral edges thereof, as seen in FIG. 9.

I claim:

1. Container packing system for use with conveyed articles, the system comprising:

a carton having four sidewalls with first, second, third and fourth carton upper edges and first, second, third and fourth carton lower edges;

first, second, third and fourth upper flaps connected to the respective first, second, third and fourth upper edges;

first, second, third and fourth lower flaps connected to the respective first, second, third and fourth lower edges, the four sidewalls defining a carton inner space sized to receive therein a layer of the conveyed articles; and a movable support platform for receiving thereon the conveyed articles and being shaped and dimensioned for location in the carton space between the four sidewalls, the support platform being actuatable to move between the upper edges and the lower edges, the first and second lower flaps being folded inwardly and upwardly towards a lower surface of the movable support platform.

2. The system, according to claim 1, in which the third and fourth lower flaps depend downwardly from the third and fourth carton lower edges, the third and fourth lower flaps being located below the lower surface of the support platform.

3. The system, according to claim 2, in which the third and fourth lower flaps fold inwardly and towards each other to close a carton lower end.

4. The system, according to claim 3, in which the first and second lower flaps are sized and dimensioned smaller than the third and fourth lower flaps.

5. The system, according to claim 1, in which the first upper flap is folded outwardly and towards a conveyor belt having thereon the conveyed articles, the first upper flap being sandwiched between a pair of sandwich plates located at a conveyor belt end and connected to a sandwich plate support, the sandwich plates including an upper fixed plate and a lower hinged plate.

6. The system, according to claim 5, in which the conveyor belt, the first upper flap and the movable support platform are located in a common generally horizontal plane relative to each other, the articles moving from the conveyor belt over the upper fixed plate and onto the movable support platform.

7. The system, according to claim 6, in which the lower hinged plate is actuatable between an open configuration for receiving the first upper flap and a closed flap holding configuration.

8. The system, according to claim 7, in which the movable support platform includes a support shaft having a vertical support shaft axis generally centrally positioned relative to the four sidewalls.

9. The system, according to claim 8, in which the movable support platform includes two side panels depending downwardly therefrom.

10. The system, according to claim 9, in which the first and second lower flaps rest against the two side panels.

11. The system, according to claim 10, in which a bottom sheet supporting a plurality of partition walls thereon is located on the movable platform, each partition wall defining an article receiver portion.

12. The system, according to claim 11, in which the articles are packed into adjacent article receiver portions in different orientations, the articles being packed into alternating orientations to attain a layer of articles.

13. The system, according to claim 12, in which the carton is a square box.

14. The system, according to claim 13, in which the carton is a rectangular box.

15. A method of packing a carton with articles from a conveyor belt, comprising:

moving downwardly first and second lower carton flaps folded inwardly and upwardly towards a lower surface of a movable support platform, the movable support platform being sized and dimensioned to be located between four carton sidewalls and to receive thereon the articles, so as to pack the carton with a layer of the articles.

16. The method, according to claim 15, further comprising:

folding the first and second lower carton flaps inwardly and upwardly towards the lower surface of the support platform, the support platform being moveable away from an upper carton end.

17. The method, according to claim 16, further including:

folding third and fourth lower carton flaps inwardly and towards each other.

18. The method, according to claim 17, in which the carton includes:

first, second, third and fourth carton upper edges and first, second, third and fourth carton lower edges;

first, second, third and fourth upper flaps connected to the respective first, second, third and fourth upper edges; and the first, second, third and fourth lower flaps being connected to the respective first, second, third and fourth lower edges.

19. The method, according to claim 18, in which the third and fourth lower flaps depend, downwardly from the third and fourth carton lower edges, the third and fourth lower flaps being located below the lower surface of the support platform.

20. The method, according to claim 19, in which the third and fourth lower flaps fold inwardly and towards each other to close a carton lower end.

21. The method, according to claim 20, in which the first and second lower flaps are sized and dimensioned smaller than the third and fourth lower flaps.

22. The method, according to claim 21, in which the first upper flap is folded outwardly and towards a conveyor belt having thereon the conveyed articles, the first upper flap being sandwiched between a pair of sandwich plates located at a conveyor belt end and connected to a sandwich plate support, the sandwich plates including an upper fixed plate and a lower hinged plate.

23. The method, according to claim 22, in which the conveyor belt, the first upper flap and the movable support platform are located in a common generally horizontal plane relative to each other, the articles moving from the conveyor belt over the upper fixed plate and onto the movable support platform.

24. The method, according to claim 23, in which the lower hinged plate is actuatable between an open configuration for receiving the first upper flap and a closed flap holding configuration.

25. The method, according to claim 24, in which the movable support platform includes a support shaft having a vertical support shaft axis generally centrally positioned relative to the four sidewalls.

26. The method, according to claim 25, in which the movable support platform includes two side panels depending downwardly therefrom.

27. The method, according to claim 26, in which the first and second lower flaps rest against the two side panels.

28. The method, according to claim 27, in which a bottom sheet support a plurality of partition walls thereon is located on the movable platform, each partition wall defining an article receiver portion.

29. The method, according to claim 28, in which the articles are packed into adjacent article receiver portions in different orientations, the articles being packed into alternating orientations to attain a layer of articles.

30. The method, according to claim 29, in which the cartoon is a square box.

31. The method according to claim 30, in which the cartoon is a rectangular box.

* * * * *